US007728532B2

(12) United States Patent
Peng

(10) Patent No.: US 7,728,532 B2
(45) Date of Patent: Jun. 1, 2010

(54) CIRCUIT DEVICE FOR LIGHT-EMITTING DIODE DRIVING AND STABILIZING SYSTEM

(75) Inventor: Ivan Peng, Hsinchu County (TW)

(73) Assignees: Top-Bound Enterprise Co., Ltd., Taipei County (TW); Ruey Chiann Technology Co., Ltd., Hsinchu County (TW)

( * ) Notice: Subject to any disclaimer, the term of this patent is extended or adjusted under 35 U.S.C. 154(b) by 230 days.

(21) Appl. No.: 12/116,386

(22) Filed: May 7, 2008

(65) Prior Publication Data

US 2009/0278471 A1 Nov. 12, 2009

(51) Int. Cl.
*H05B 37/02* (2006.01)

(52) U.S. Cl. ..... 315/301; 315/185 R; 315/226; 315/307

(58) Field of Classification Search ..... 315/185 R, 315/186, 192, 200 R, 209 R, 224–226, 244, 315/245, 291, 299, 301, 307, 312, 324
See application file for complete search history.

(56) References Cited

U.S. PATENT DOCUMENTS 6,577,072 B2 * 6/2003 Saito et al. ..... 315/185 R
2008/0018267 A1 * 1/2008 Arakawa et al. ..... 315/301
2009/0195170 A1 * 8/2009 Pai et al. ..... 315/201

* cited by examiner

*Primary Examiner*—Thuy Vinh Tran
(74) *Attorney, Agent, or Firm*—Rabin & Berdo, P.C.

(57) ABSTRACT

A circuit device for an LED's driving and stabilizing system includes an AC/DC controllable driving voltage source, a feedback driving controller, an LED demodulation driving controller controllable driving voltage source, an external regulator, and an LED modular device. While various internal conditions or factors of the circuit device may be obtained through integrally or partially setting and computing, the circuit device may also be externally connected to an input signal source according to the characteristics of different attributive conditions to thereby achieve the function of automatic regulation, enabling the LED modular device connected thereto and having been used over a long period of time to have lowered brightness attenuation rate, reduced power loss, reduced heat generation, and accordingly, extended the LED's lifespan.

8 Claims, 2 Drawing Sheets

CIRCUIT DEVICE FOR LIGHT-EMITTING DIODE DRIVING AND STABILIZING SYSTEM

FIELD OF THE INVENTION

The present invention relates to a circuit device for a light-emitting diode (LED) driving and stabilizing system. While various internal conditions or factors of the circuit device may be obtained through integrally or partially setting and computing, the circuit device may also be externally connected to an input signal source according to the characteristics of different attributive conditions to thereby achieve the function of automatic regulation, enabling an LED modular device connected thereto and having been used over a long period of time to have lowered brightness attenuation rate, reduced power consumption, reduced heat generation, and accordingly, extended the LED's lifespan.

BACKGROUND OF THE INVENTION

With the rapid development in technological fields, light-emitting diodes (LEDs) have gradually replaced the bulbs and mercury-containing fluorescent tubes as a light source in commercially available illuminating devices. This is because the LED has low power consumption, long service life, no idling time, and fast response speed, and is flicker-free to protect a user against sore eyes. Moreover, the LED is small in size, vibration-proof, easy for mass production, and may be produced into an extremely small size or an array-type element. Therefore, the LED has been widely used as a light source in digitalized 3C products, automobile lamps, and ornamental lamps. It can be seen that the LED has become a main light source in the development of future illuminating field.

While the currently available LED light source has reached a considerably high brightness, there are still some technical problems in the LED that need improvements. The first problem with LED is heat dissipation. Most of the commercially available LED products and patents to the prior art LEDs pay a lot of attention to the heat radiation efficiency of the LED. While some conventional LEDs have good heat dissipation efficiency to avoid being overheated, these conventional LEDs consume more power supply. And, when the LEDs have been used over a long period of time, they are subject to a gradually increased brightness attenuation rate and accordingly shortened the lifespan.

Further, when the LED is used as a light source for an illuminating device, the illuminating device must only be connected to a direct current (DC) power supply. An alternating current (AC) power supply cannot be used with the LED. Therefore, when it is desired to widely use the LED to replace general lighting devices and illuminating products, an AC/DC converter must be provided along with the lighting devices or illuminating products that use LED as a light source thereof. By doing this, it would inevitably bring inconveniences to the users.

SUMMARY OF THE INVENTION

The primary objective of the present invention is to provide a circuit device as an LED's driving and stabilizing system to lower the brightness attenuation rate and extend the lifespan of the LED.

Another objective of the present invention is to provide a circuit device as an LED's driving and stabilizing system to reduce the power consumption and the heat generated by the LED during operation.

To achieve the above objectives, the present invention includes an AC/DC controllable driving voltage source for externally connecting to a public AC voltage source, converting the AC voltage source into a DC voltage source, and supplying to an LED modular device and other associated circuit elements in the LED driving and stabilizing system; an LED modulation driving controller controllable voltage source for further supplying the LED modular device and other associated circuit elements in the LED driving and stabilizing system with an active and stable power source having conditions set through overall selectivity; when the AC/DC controllable driving voltage source has converted the public AC voltage source into a DC voltage source, a feedback driving controller being actuated to start operating when the AC/DC controllable driving voltage source has been connected to the public AC voltage source, so as to achieve short-circuit protection and polarity reversal protection, and the feedback driving controller having an internal control circuit enabling automatic detecting, comparing, and determining of a circuit state of the LED modular device having conditions set through overall selectivity; an external regulator connected to an outer side of the circuit device for external control signal input (I/O) into the circuit device; and an LED modular device for illuminating purpose.

In an operable embodiment of the present invention, the feedback driving controller provides short-circuit protection and polarity reversal protection for protecting the circuit device when it is first installed.

In another operable embodiment of the present invention, when the internal control circuit of the feedback driving controller conducts automatic detecting, comparing, and determining of the circuit state of the LED modular device having conditions set through overall selectivity, the conditions of the circuit being set through overall selectivity include temperature, voltage, current, frequency, power, and power efficiency.

In a preferred embodiment of the present invention, the LED modular device has more than one driven LED of different types, combinations, and shapes connected thereto in series.

In another preferred embodiment of the present invention, the LED modular device has more than one driven LED of different types, combinations, and shapes connected thereto in parallel.

In a further preferred embodiment of the present invention, the LED modular device has more than two driven LED of different types, combinations, and shapes connected thereto in series-parallel connection.

In another operable embodiment of the present invention, the external regulator is adapted to externally change the resistance/impedance value between the external regulator and the ground.

In another preferred embodiment of the present invention, the public AC power supply, the LED modular device, and the external regulator are interconnected through bus line, so that bidirectional one-to-many points signal output and input may be performed between the circuit device and the LED modular device and the external regulator; and the LED modular device and the external regulator may accept the control and detection by the internal control circuit of the feedback driving controller.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
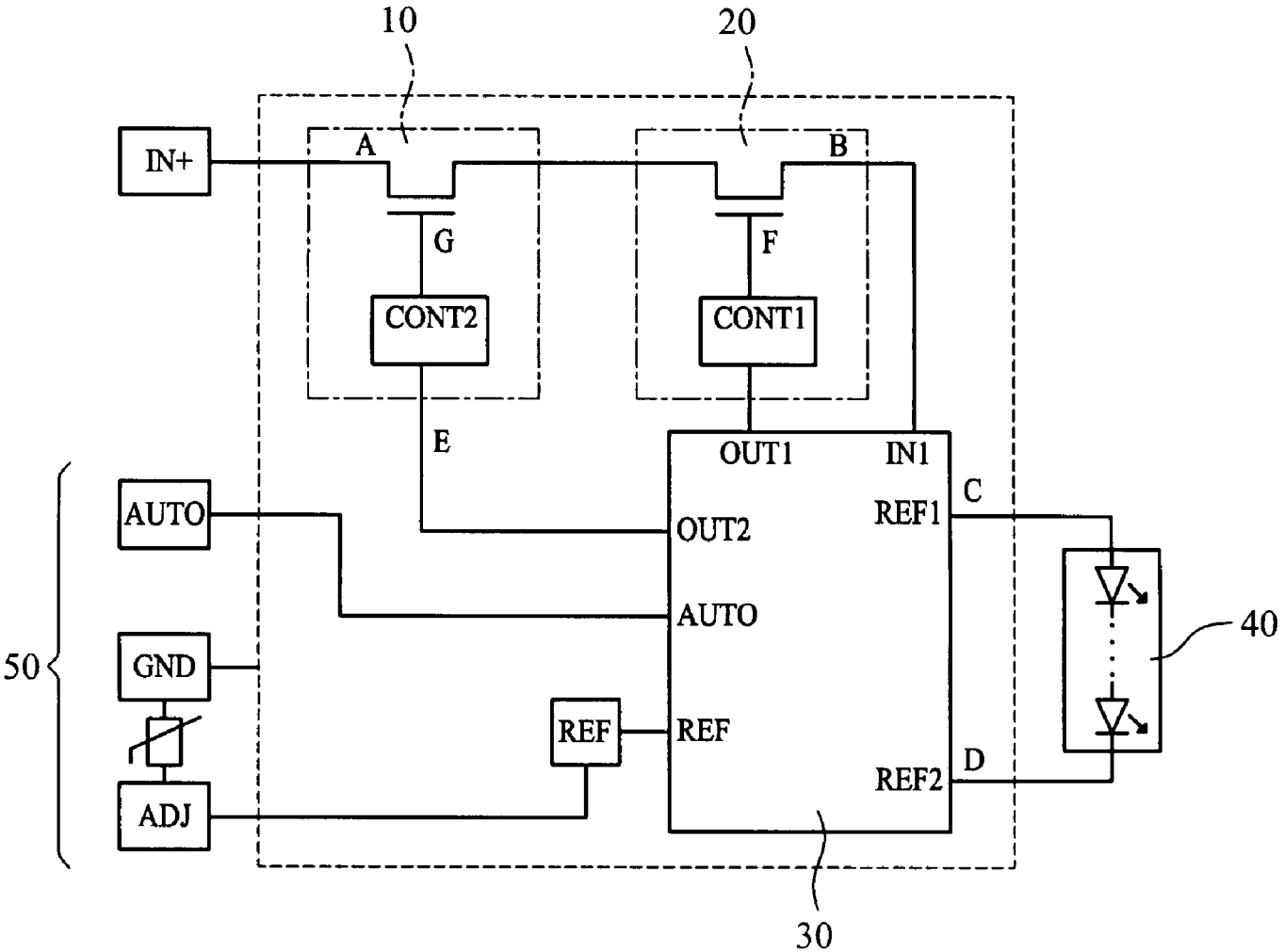
FIG. 1 is a block diagram showing an internal structure of the present invention.

Please refer to FIG. 1, which is a block diagram of a circuit device for an LED driving and stabilizing system according to a preferred embodiment of the present invention. As shown, the circuit device includes an AC/DC controllable driving voltage source 10, via which the circuit device is externally connected to a public power supply. The AC/DC controllable driving voltage source 10 is used mainly to convert an AV voltage source of the public power supply into a DC voltage source for supplying to an LED modular device 40 at a rear end of the circuit device, and to other associated circuit elements in the LED driving and stabilizing system.

The circuit device further includes an LED modulation driving controller controllable voltage source 20. When the circuit device has been electrically connected to the public power supply and the AC/DC controllable driving voltage source 10 has converted the public AC voltage source into a DC voltage source, the LED modulation driving controller controllable voltage source 20 further supplies the LED modular device 40 and other associated circuit elements in the LED driving and stabilizing system with an active and stable power source that has conditions set through overall selectivity.

Figure 2:
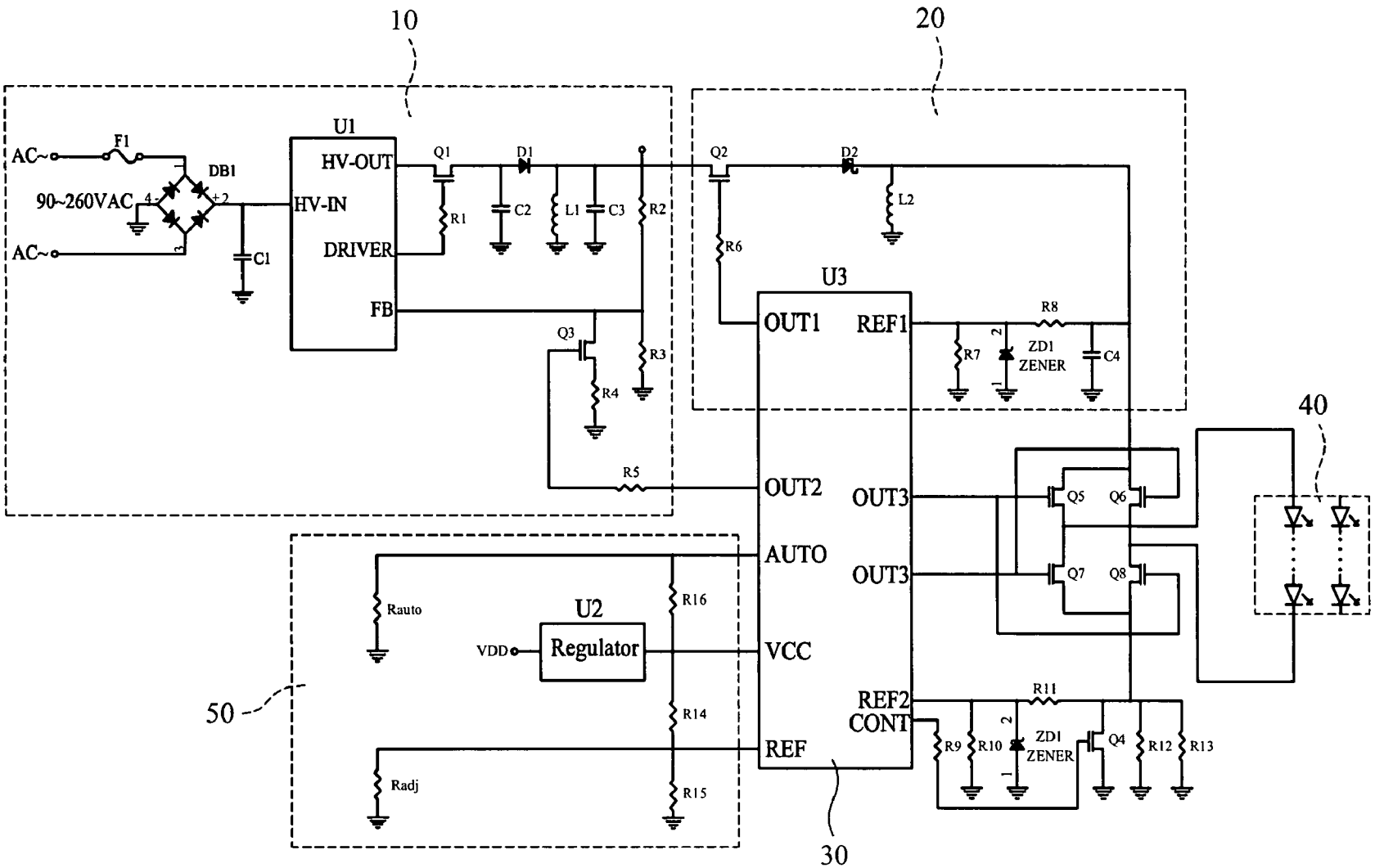
FIG. 2 is a detailed circuit diagram of the present invention.

Please also refer to FIG. 2, which is a detailed circuit diagram of the circuit device of the present invention. As shown, the circuit device of the present invention further includes a feedback driving controller 30, which would automatically actuate a short-circuit protection and a polarity reversal protection when the circuit device is first installed for use.

When the circuit device is first installed for use, a control end of the feedback driving controller 30 would send out a signal (OUT3) in correspondence to the positive-connected (Q5) and the negative-connected (Q8) to identify and determine the action (ON). Meanwhile, the LED modulation driving controller controllable voltage source 20 starts operating to detect whether there is a voltage drop at a detection end (REF2). If not, it means the LED modular device 40 has been connected to the DC power supply end with reversed positive and negative polarities, preventing the LED modular device 40 from being successfully electrically connected to the circuit device of the present invention. Under this circumstance, the LED modulation driving controller controllable voltage source 20 would be automatically cut off, and the control end of the feedback driving controller 30 would send out a reversal polarity signal ($\overline{\text{OUT3}}$) in correspondence to the positive-connected (Q6) and the negative-connected (Q7) to identify and determine the action (ON). In this manner, it is possible to achieve the polarity reversal protection and the short-circuit protection.

The above-mentioned protections are mainly designed to prevent destruction of the circuit device caused by an external force; that is, to protect the circuit device from being disassembled to result in short circuit, open circuit, or even an incomplete functional structure. Such protections are achieved by providing the feedback driving controller 30 with an internal control circuit, which enables one-to-many point contact of the circuit device of the present invention with connecting terminals provided on an external structure. The internal control circuit of the feedback driving controller 30 is capable of automatic detection to identify and determine whether the circuit device of the present invention is in a complete state. Similarly, the internal control circuit of the feedback driving controller 30 enables one-to-many point contact of the circuit device of the present invention with connecting terminals provided in the LED modular device 40, and would automatically detect, identify, and determine whether the LED modular device 40 is a device specified for the complete circuit device of the present invention.

When the circuit device and the LED modular device 40 have been determined by the feedback driving controller 30 as complete and correct devices, an end REF1 of the feedback driving controller 30 would detect the voltage applied across the LED modular device 40, and the internal control circuit of the feedback driving controller 30 would regulate the driving source needed by the LED modular device 40 according to the required characteristics of the circuit state of the LED modular device 40 having conditions set through overall selectivity, including temperature, voltage, current, frequency, power, and power efficiency. Again, the internal control circuit of the feedback driving controller 30 would automatically detect, compare, and determine the circuit state of the LED modular device 40 having conditions set through overall selectivity.

Depending on actual needs when in use, the illustrated LED modular device 40 may be connected to one or more LEDs in series or in parallel, or connected to two or more LEDs in series-parallel connection.

The present invention also has an externally connected regulator 50. The external regulator 50 includes two parts, namely, AUTO and ADJ. When a control signal source (I/O) is input via the part AUTO, the internal control circuit of the feedback driving controller 30 would automatically regulate and obtain a desired condition value (i.e., a signal) set through overall selectivity. And, by externally adding at least one resistance/impedance value R to the complete circuit device of the present invention, the obtained condition value (signal) set through overall selectivity may generate at least one potential difference in the voltage source to achieve regulation, change, and selection thereof.

When a resistance/impedance value between the part ADJ and a ground GND is externally changed, the part ADJ would generate at least one potential difference in the voltage source. Then, an internal parameter system of the feedback driving controller 30 would automatically calculate the condition value (i.e. signal) at the REF in the circuit device set through overall selectivity, and conduct automatic detection and comparison based on the calculated condition value. And, a difference in the determined value means that, in the set conditions of temperature, voltage, current, frequency, power, and power efficiency, the items that require change and regulation are variable.

Further, the public AC power supply, the LED modular device 40, and the external regulator 50 are interconnected through bus line, so that bidirectional one-to-many points signal output and input may be performed between the circuit device and the LED modular device 40 and the external regulator 50. The LED modular device 40 and the external regulator 50 may accept the control and detection by the internal control circuit of the feedback driving controller 30.

Therefore, the present invention provides a circuit device as an LED's driving and stabilizing system. With an automatic regulating function of the circuit device, an LED modular device connected thereto and having been used over a long period of time may have lowered brightness attenuation rate, reduced power consumption, and reduced heat generation to thereby have an extended lifespan.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A circuit device for an LED's driving and stabilizing system, comprising:

an AC/DC controllable driving voltage source for externally connecting to an AC voltage source of a public power supply and converting the public AC voltage source into a DC voltage source for supplying to LEDs and other associated circuit elements in the LED driving and stabilizing system;

an LED modulation driving controller controllable voltage source for further supplying the LEDs and other associated circuit elements in the LED driving and stabilizing system with an active and stable power source having conditions set through overall selectivity when the AC/DC controllable driving voltage source has converted the public AC voltage source into a DC voltage source;

a feedback driving controller being actuated to start operating when the AC/DC controllable driving voltage source has been connected to the public AC voltage source, so as to provide short-circuit protection and polarity reversal protection to the circuit device; and the feedback driving controller having an internal control circuit capable of automatically detecting, comparing, and determining a circuit state of an LED modular device having conditions set through overall selectivity;

an external regulator connected to an outer side of the circuit device for externally inputting a control signal source (I/O) to the circuit device; and an LED modular device for illuminating purpose connected to the circuit device.

2. The circuit device for an LED's driving and stabilizing system as claimed in claim 1, wherein the feedback driving controller provides the short-circuit protection and the polarity reversal protection when the circuit device is first installed for use.

3. The circuit device for an LED's driving and stabilizing system as claimed in claim 1, wherein the conditions for the circuit of the LED modular device set through overall selectivity include temperature, voltage, current, frequency, power, and power efficiency.

4. The circuit device for an LED driving and stabilizing system as claimed in claim 1, wherein the LED modular device has more than one LED of different types, combinations, and shapes connected thereto in series.

5. The circuit device for an LED driving and stabilizing system as claimed in claim 1, wherein the LED modular device has more than one LED of different types, combinations, and shapes connected thereto in parallel.

6. The circuit device for an LED's driving and stabilizing system as claimed in claim 1, wherein the LED modular device has more than two LEDs of different types, combinations, and shapes connected thereto in series-parallel connection.

7. The circuit device for an LED's driving and stabilizing system as claimed in claim 1, wherein the external regulator is adapted to externally change a resistance/impedance value between the external regulator and a ground.

8. The circuit device for an LED's driving and stabilizing system as claimed in claim 1, wherein the public AC power supply, the LED modular device, and the external regulator are interconnected through bus line, so that bidirectional one-to-many points signal output and input may be performed between the circuit device and the LED modular device and the external regulator; and the LED modular device and the external regulator may accept control and detection by the internal control circuit of the feedback driving controller.

* * * * *